United States Patent [19]

Schimmel

[11] 4,210,306

[45] Jul. 1, 1980

[54] SAFETY KEY AND LOCKING MEANS THEREFOR FOR USE WITH CONCRETE WALL FORM PANELS

[75] Inventor: Vernon R. Schimmel, Chicago, Ill.

[73] Assignee: Symons Corporation, Des Plaines, Ill.

[21] Appl. No.: 907,138

[22] Filed: May 18, 1978

[51] Int. Cl.[2] ..... E04G 11/06

[52] U.S. Cl. ..... 249/196; 249/192; 249/216; 249/218

[58] Field of Search ..... 249/196, 213, 216, 217, 249/218, 192, 44, 45, 46, 47, 189, 190, 191; 425/213

[56] References Cited

U.S. PATENT DOCUMENTS

| | | | |
|---|---|---|---|
| 871,390 | 11/1907 | Dietrichs | 249/216 |
| 1,978,963 | 10/1934 | Schwaab | 249/218 |
| 2,162,349 | 6/1939 | Hillberg | 249/213 |
| 2,976,597 | 3/1961 | Elam | 249/213 |
| 3,067,479 | 12/1962 | Schimmel | 249/192 |
| 3,661,354 | 5/1972 | Dagiel et al. | 249/192 |

*Primary Examiner*—Donald J. Arnold

*Attorney, Agent, or Firm*—Norman H. Gerlach; John S. O'Brien

[57] ABSTRACT

A safety key designed specifically for use in connection with concrete wall form panels of the "Steel-Ply" or metal-encased type. The key affords an anchor eyelet or hole for receiving the hook which invariably is provided on one end of a safety belt that is worn by a workman who is obliged to work on the concrete wall form at an extremely high or unsafe level or elevation. The key in one form of the invention embodies a shank and an enlarged head, the shank being received in the opposed notches which are formed in the outermost abutting ribs of the mating and abutting frame members or bars of the marginal reinforcing frames of two adjacent wall form panels, and being removably locked in place by a pair of conventional coacting wedge bolts. The enlarged head on the shank defines the aforementioned anchor eyelet or hole. Alternatively, the shank of the key is capable of being received through a pair of registering bolt-receiving slots in such mating and abutting frame members or bars and of being locked in place by a single wedge bolt.

2 Claims, 4 Drawing Figures

SAFETY KEY AND LOCKING MEANS THEREFOR FOR USE WITH CONCRETE WALL FORM PANELS

The present invention relates generally to concrete wall form accessories and has particular reference to a novel anchoring device in the form of a safety key which affords an eyelet that is designed for reception therein of the hookequipped end of a workman's safety belt, to the end that the user of the belt, when operationg at a high level on the concrete wall form, may attach his safety belt to the anchoring device as a precautionary safety measure.

The present anchoring device is designed specifically for use in connection with concrete wall forms the spaced apart sides of which utilize in side-by-side relation prefabricated wall form panels which are commonly known as "Steel-Ply" panels, such panels being manufactured and sold by Symons Corporation of Des Plaines, Illinois. "Steel-Ply" panels, in various sizes, are widely used in the concrete building industry. They are assembled at the factory rather than in the field, and when shipped to the site or place of use, they are capable of use without any modification whatsoever. Such panels are of special construction in that they are designed to be used with various articles of concrete hardware which also are of special construction and permit the panels to be quickly and easily erected in a wall form installation and subsequently removed from the installation for reuse after they have served their purpose.

A concrete wall form panel of the "Steel-Ply" type consists essentially of a rectangular, shallow, tray-like structure in the form of a rectangular plywood facing the edges of which are completely encased in or surrounded by a metallic rectangular reinforcing frame comprising vertically and horizontally extending, channel-shaped frame members or bars, together with a series of parallel, vertically spaced apart crossbars which are of the angle bar type and extend between the vertical frame members and lend reinforcement to the medial or central regions of the plywood facing by consitituting a backing therefor. Such a panel is adapted to be set up in edge-to-edge relationship with similar panels in order to form one side of a concrete wall form wherein the plywood facings of the panels of each form side oppose the facings of the panels of the other form side in spaced relationship and wet concrete is adapted to be poured between the two form sides in order to form the desired concrete wall.

In order to accommodate the concrete hardware which is used with panels of the "Steel-Ply" type, the vertical and horizontal frame members of the rectangular reinforcing frames of the panels have formed therein aligned or registering transverse slots. Most of the hardware that is employed is designed to cooperate with these slots, and included in such hardware are conventional pairs of wedge bolts which are employed for drawing the adjacent edges of the edge-to-edge panels together and holding them securely in place. When such pairs of wedge bolts are in place, the shanks of certain of the bolts provide anchoring points for the looped or apertured ends of horizontally extending tie rods which extend between the opposite sides of the final or completed concrete wall form installation. In order that the various panels may be interlocked with one another regardless of their positions in space, and also in order to accommodate such special hardware as waler clamps and the like at the same horizontal level, it is necessary that the transverse slots in the channel-shaped frame members or bars be positioned at equally spaced centers.

In addition to the provision of the aforementioned transverse slots which essentially are wedge bolt-receiving slots, and are usually disposed on one-foot centers, each slot has associated with it at the same horizontal level a notch, the disposition of which is such that when two panels are brough into their edge-to-edge relationship for slot alignment or registering purposes, the two notches which are associated with such slots also register with each other and define therebetween an opening or void through which a tie rod may project if, in fact, such a tie rod is to be used at the particular level of the slots and their associated notches. However, tie rods are not usually employed at each slot level, and when no such tie rod is present, the registering notches and slots remain intact but without function.

The particular safety key constituting the present invention is designed for selective use in connection with any unused slot and notch combination and at any desired level. Briefly, the safety key of the present invention is comprised of a flat metal (preferably steel) stamping having the general outline of a conventional key of the type now being used for opening door locks and the like, thus giving rise to the name "safety key" although, of course, the safety key has no locking or unlocking function and may in some instances have a shape other than that of a key. The reduced shank portion of the key is capable of being inserted in various ways into voids which are provided by any of the various unused slot and notch combinations which are present in connection with a concrete wall form of the "Steel-Ply" panel type while the enlarged head of the key, which is provided with an anchor eyelet or hole therethrough, remains exposed. Where mating vertical frame members or bars of the reinforcing frames of adjacent panels are concerned, the shank of the safety key may either be inserted into the void which exists between registering notches so that the plane of the key lies vertically or it may be inserted through an unused pair of registering slots in such vertical frame bars so that its general plane lies horizontally. In either event, the enlarged head of the key remains exposed for reception of the hook which as previously pointed out is invarably provided at the free end of a workman's safety belt.

Where mating horizontal frame members or bars are concerned, the shank of the safety key may either be inserted into the void between registering notches so that the plane of the key lies horizontally, or it may be inserted through mating slots so that the plane of the key lies vertically. When the shank portion of the key is passed through a pair of registering slots, it may be introduced through such slots in either direction and thus, with most conventional "Steel-Ply" type concrete wall form installations, the key is capable of assuming six diffeerent functional positions, not to mention the fact that the key is reversible in side-to-side fashion, in which case it may assume twelve different positions.

Regardless of the particular orientation which the key may be used in connection with a "Steel-Ply" type concrete wall form, means are provided whereby it may be securely locked in place against dislodgment, such means in the case of projection of the shank through registering notches consisting of a pair of conventional wedge bolts. In the case of projection of the shank of the key through registering slots, a single wedge bolt is used for locking purposes.

Heretofore, in order to lend a particular degree of safety to a workman who is operating at a dangerous level on a "Steel-Ply" type concrete wall form, it has been the practice to utilize relatively wide walers which are secured to the outside of the form by conventional waler clamping devices so that the walers extend horizontally and afford a walkway for movement of the workman. In some instances, guard rails are erected to prevent the workman from mishap. By the use of the present safety key, which a workman may carry in his pocket or pouch, the use of a guard rail may be dispensed with, it being necessary for the workman merely to select a suitable vacant notch-formed void where he may insert the shank of the safety key, lock it in place by one or more wedge bolts, hook the free end of this safety belt into the eyelet or hole in the enlarged head of the key, and proceed with the work at hand. In the unusual event where a given concrete wall form requires attention at a particular high elevation, a workman may, by carrying several safety keys and wedge bolts with him, ascend the form by inserting and removing the safety keys progressively, or descend the form somewhat in the manner that a mountain climber establishes reaction points for vertical ascent or descent.

The provision of a safety key, together with its locking means, such as has briefly been outlined above, and possessing the stated advantages, constitutes the principal object of the present invention.

A further object of the invention is to provide a safety key which is essentially of simple design, may be produced at a low cost, and effectively and efficiently fulfills its intended purpose.

Numerous other objects and advantages of the invention, not at this time enumerated, will readily suggest themselves as the nature of the invention is better understood from a consideration of the following detailed description or specification.

The invention consists in the several novel features which are hereinafter described and are more particularly defined by the claims at the conclusion hereof.

In the accompanying single sheet of drawings forming a part of this specification, one illustrative embodiment of the invention is shown and several modes of its operation are portrayed as described in this specification.

Figure 1:
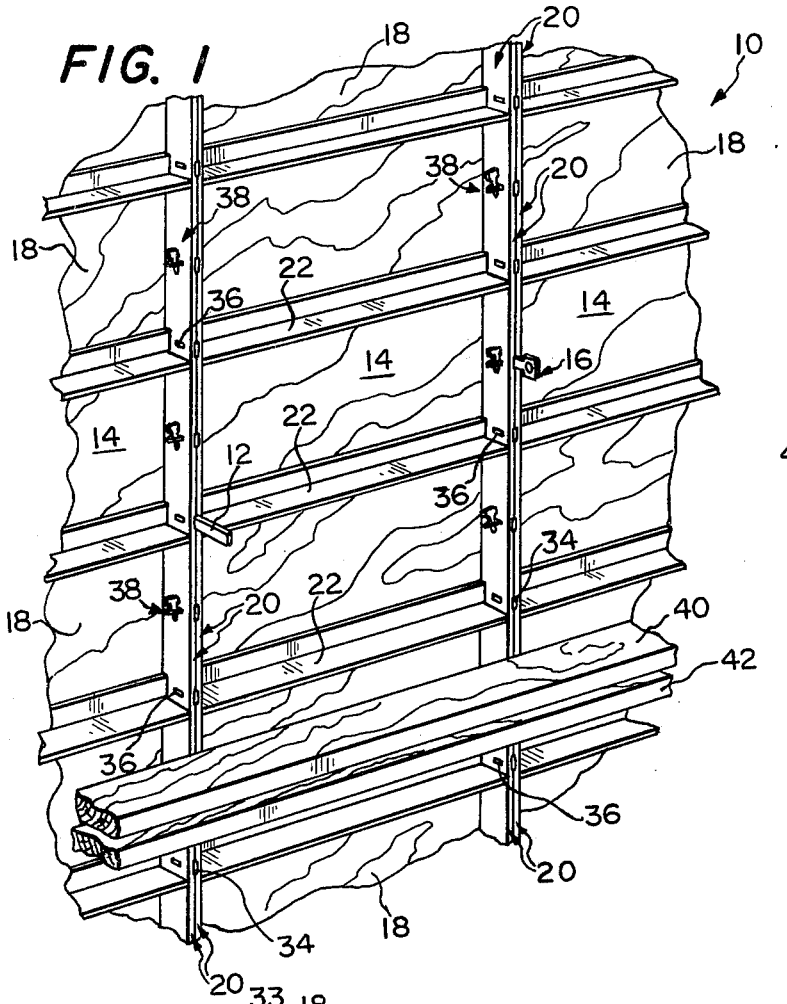
FIG. 1 is a fragmentary outside perspective view of a portion of one side of a concrete wall form utilizing "Steel-Ply" panels and showing a safety key embodying the invention operatively installed therein.
Figure 3:
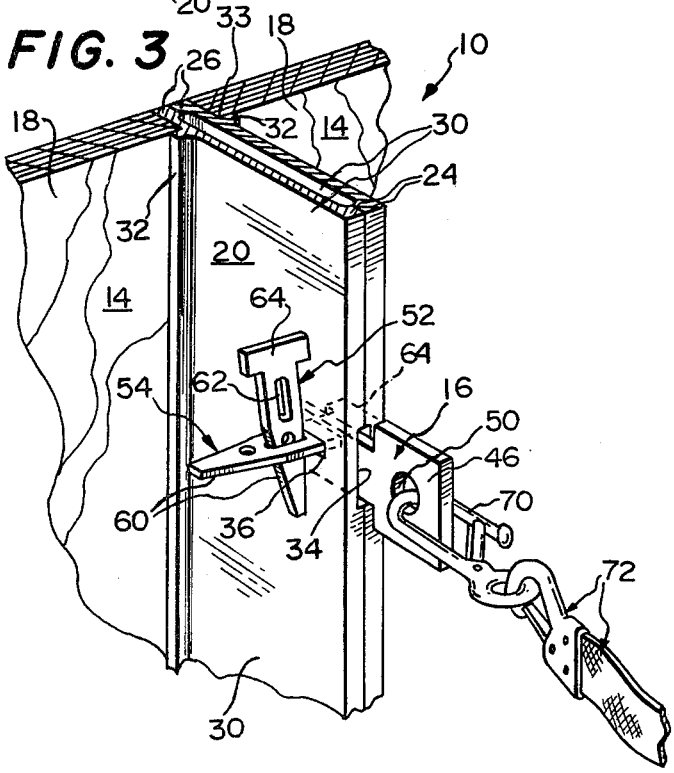
Figure 4:
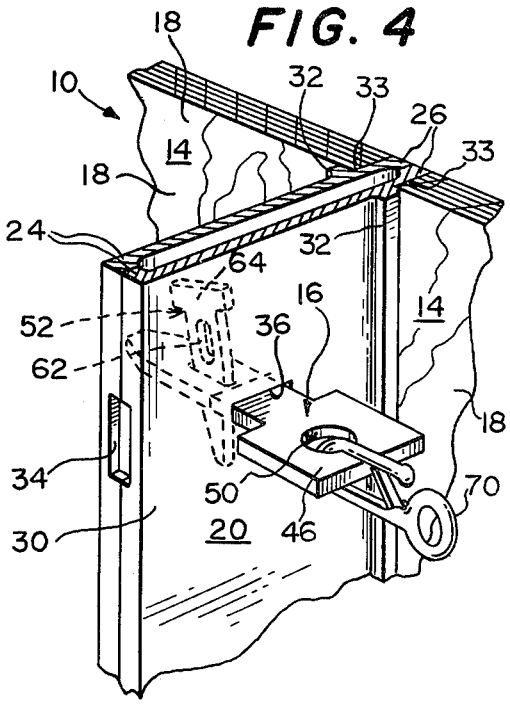

FIG. 3 is an enlarged fragmentary outside perspective view of a portion of the form side of FIG. 1, the view being taken in the vicinity of the installed safety key and showing one manner of installing the key with respct to the form side; and FIG. 4 is a perspective view similar to FIG. 3 but illustrating an alternative manner of installing the safety key in securely locked position on the concrete wall form.

Referring now to the drawings in detail and in particular to FIG. 1, a fragmentary portion of one side of a composite concrete wall form of the "Steel-Ply" panel type is illustrated and it is designated by the reference numeral 10. It is to be understood that the wall form side 10 which is disclosed in FIG. 1 of the drawings is opposed by a similar wall form side and that the two sides are connected together and held in spaced apart relationship by a series of horizontally extending tie rods 12, only one of which is illustrated in FIG. 1. As will be set forth in greater detail presently, these tie rods project through certain notches that are formed to receive the end regions thereof and are secured in place by wedge bolts in a manner that is well known in the art of erecting "Steel-Ply" panels to produce or form a concrete wall form.

Each side of the wall form is made up of a series of rectangular wall form panels 14 with the panels being arranged in upstanding and edge-to-edge relationship. The individual panels 14 are conventional in their design and no claim is made herein to any novelty that may be associated with them, the novelty of the present invention residing rather in the construction and design of a particular safety key which is designated in its entirety by the reference numeral 16 and is shown in detail in FIG. 2 of the drawings, together with means for locking such safety key in position on the wall form installation, all in a manner that will be made clear presently.

In FIG. 1 of the drawings, fragmentary portions of three wall form panels 14 are shown. Each of these panels is of the prefabricated "Steel-Ply" type, which is to say that they consist of rectangular plywood facings 18 having marginal rectangular reinforcing frames applied to their outer surfaces. Such frames consist of vertical and horizontal frame members, only the vertical frame members 20 being illustrated in FIG. 1. At appropriate levels in each panel 14, suitable horizontal crossbars 22 of angle bar type extend across the outer surfaces of the plywood panel and between the opposed vertical frame members 20 of the reinforcing frame.

Specifically, the vertical frame members 20 of each rectangular reinforcing frame are in the form of structural steel members which are generally of shallow U-shape cross section (see particularly FIGS. 3 and 4) and each comprises spaced outer and inner, longitudinally extending, parallel, outwardly projecting ribs 24 and 26, and a flat connecting base or web portion 30. On the side of the web portion 30 which is opposite to the ribs 24 and 26, an integral shallow, longitudinally extending rib 32 defines a groove-like pocket or recess 33 for reception therein of the adjacent vertical edge region of the associated plywood facing 18. The horizontal crossbars 22 have their ends welded to the inside surfaces of the web portions 30 of the vertical frame members 20.

At vertically spaced regions along the vertical frame members 20 the ribs 24 and 26 are provided with notches 34 in order to accommodate the ends of the tie rods 12 while the web portions 30 of the vertical frame members are formed with rectangular, transversely extending openings or slots 36 in horizontal alignment with the notches 34 for reception therethrough of conventional wedge bolt assemblies 38 by means of which adjacent panels 14 are drawn tightly together and also by means of which the tie rods 12 are secured at their end regions in position.

As previously stated, only the vertical frame members 20 of the panel units 14 are disclosed in the drawings, the horizontal frame members being omitted. It will be understood, however, that these horizontal frame members are similar to the vertical frame members 20 and are similarly provided with outer and inner, outwardly and longitudinally extending marginal ribs, tie rod-receiving notches and wedge bolt assemblies. Ordinarily, however, tie rods are not used with the notches of the horizontal frame members, their use with the notches of the vertical frame members being considered adequate for form side spacing purposes. For a fuller understanding of the nature of the various panel units 14, and for a full disclosure of the horizontal frame bars associated therewith, reference may be had to U.S. Pat. No. 3,171,186, granted on Mar. 2, 1965, and entitled "WALL FORM PANEL WITH INHERENTLY REINFORCED CROSSBARS," the entire subject matter of which patent is hereby incorporated in and made a part of the present application insofar as it is consistent with the present disclosure.

Still referring to FIG. 1 of the drawings, a pair of horizontal walers consisting of an upper waler 40 and a lower waler 42 extends across the outside of the form side 10, and these walers may be secured in position on the form by any of a wide variety of waler clamping devices (not shown). Exemplary of a suitable waler clamping bracket is U.S. Pat. No. 3,584,829, granted on June 15, 1971, and entitled "SELF-CONTAINED WALER CLAMP ASSEMBLY FOR CONCRETE WALL FORM."

The walers 40 and 42 are usually in the form of lengths of 2"×4" and sometimes 2"×" lumber. The upper waler 40 is intended not only to render the form side 10 rigid as a whole and maintain perfect alignment of the various panels of which the said form side is formed, but also in certain instances serves as a relatively narrow walkway for a workman on the form.

Figure 2:
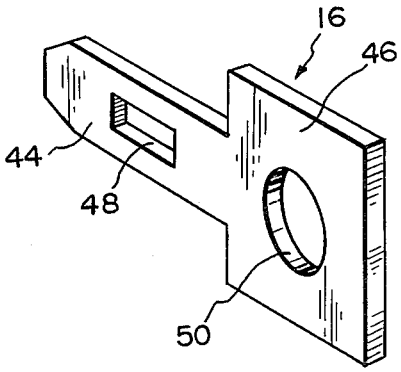
FIG. 2 is an enlarged perspective view of the safety key per se.

Considering now the nature of the safety key 16 of FIG. 2 of the drawings, such key is preferably in the form of a one-piece stamping made from flat, sheet steel stock and is generally in the shape of a conventional key which is used with a door lock or the like. Said safety key is provided with a narrow, elongated, shank portion 44 and an enlarged, substantially square head 46. The shank portion 44 has formed therein a longitudinally extending slot 48 while the head 46 has formed therein a central circular opening or hole 50. Preferably, the corners of the outer or distal end of the shank portion 48 are cut away or dispensed with in order that said front end is outwardly tapered and, hence, possesses piloting effect when the key is inserted into place as hereinafter described in connection with installation of the key.

As best shown in FIG. 3 of the drawings, the shank portion 44 is adapted to be projected into the void which exists between or is formed by a selected pair of unused registering notches 34 to such a degree that the slot 48 in the shank portion registers with the adjacent aligned slots 36 in the web portions 30 of the vertical frame members 20, after which a wedge bolt 52 is passed through the three aligned slots 36, 48, 36. Thereafter, a second wedge bolt 54 is passed through the usual longitudinal slot in the shank of the first wedge bolt and driven downwardly in order to draw two adjacent panel units 14 together in the usual manner of edge-to-edge panel unit assembly. The particular character of the wedge bolts 52 and 54 is not novel, such wedge bolts having within the past few years replaced the former individual T-bolts and separate wedges which are shown and described in aforementioned U.S. Pat. No. 3,171,186. The wedge bolts 52 and 54 are identical in construction and they are interchangeable. Specifically, and with reference to FIG. 3, each wedge bolt 52 and 54 includes a tapered shank portion 60 with a longitudinal slot 62 therein, and, in addition, an integral T-head 64. With the safety key 16 thus secured in position on the form as described in connection with FIG. 3, the enlarged head 46 remains exposed so that a workman standing on the walkway which is provided by the upper waler 40 may insert the hook portion 70 of his safety belt 72 through the circular hole 50 in said head 46 of the key. Should the workman fall, and thereby place a load on the safety belt 72, the load is transmitted to the head 46 of the safety key 16. A torque load is applied to the head 46, and the lower inner corner portion of the head bears on the outer longitudinal edge of the vertical frame members 20, i.e., the outer edges of the ribs thereof. The load is resisted by the edges of the frame members and by the wedge bolt 54 held captive in the wedge bolt-receiving slots 36.--

In FIG. 4 of the drawings, an alternative method of installing the safety key 16 on the form side 10 is shown. As shown in this view, the elongated shank portion 44 of the safety key 16 is inserted through a pair of unused or vacant slots 36 in the web portions 30 of the vertical frame members 20 of adjacent panels 14 and a single wedge bolt such as the bolt 52 is driven through the slot 48 in said shank portion. When used in this manner, the safety key 16 functions, in effect, as a T-bolt while the bolt 52 functions as a wedge. With the safety key 14 thus locked in position, the enlarged head 46 thereof remains exposed for reception of the hook portion 70 of the safety belt 72.

The invention is not to be limited to the exact arrangement of parts shown in the accompanying drawings or described in this specification as various changes in the details of construction may be resorted to without departing from the spirit or scope of the invention. For example, although the safety key has been shown in FIG. 4 as being installed with its shank portion facing generally to the left, it is obvious that the key may be inserted through the slots in the opposite direction. Also, in FIG. 3, the wedge bolt 52 may be similarly reversed as regards the direction of its shank. Still further, it has been previously stated that the reinforcing frames of the various panels 14 are provided with horizontally extending frame members that are notched and slotted in a manner similar to the notching and slotting of the vertical frame members 20. Thus, if desired, the safety key 16 may be applied to any mating or abutting pair of horizontal frame members, either by projecting the shank portion 44 thereof through the void which is created by the registering notches in such horizontal frame members, or by applying it to the registering slots in said horizontal frame members. Therefore, only insofar as the invention is particularly defined in the accompanying claims is the same to be limited.

Having thus described the invention what I claim as new and desire to secure by letters patent is:

1. A workman's safety device removably attachable in alternative positions to a concrete wall form side of the type that embodies a plurality of upstanding panels arranged in edge-to-edge relation, each panel embodying an inner facing from which there projects outwardly a marginal reinforcing frame including vertical frame members each having inner and outer, laterally outwardly extending longitudinal ribs and a flat web portion extending between the ribs, said ribs having notches at spaced centers therealong and said web portions having wedge bolt-receiving slots at spaced centers therealong and in horizontal alignment with respective notches, the frame members of adjacent panels being arranged in contiguity with the corresponding notches thereof disposed in registry and defining therebetween tie rod-receiving voids and the corresponding wedge bolt-receiving slots thereof disposed in pairs of opposed slots in horizontal alignment with respective voids, said device comprising an elongated shank portion and an integral head portion, said shank portion having a longitudinal slot therein sized to receive the shank portion of a wedge bolt therethrough, said head portion having an opening therein sized to receive the hook portion of a workman's safety belt therethrough, said shank portion of the device being sized for removable insertion of a distal end thereof in the alternative through an unused one of said voids or through an unused one of said pairs of web portion slots and having a length such that its distal end is confined between contiguous frame members when inserted through a void defined therebetween, said head portion being enlarged with respect to said shank portion of the device, said voids and said web portion slots, so as to prevent passage of the head portion through a void or a web portion slot, said slot in the shank portion of the device registering with one of said pairs of web portion slots when such shank portion is inserted through a void aligned with the one pair of slots, for receiving the shank portion of a wedge bolt through the registering slots, said slot in the shank portion of the device projecting outwardly from said frame members on the side thereof opposite to the side from which said head portion of the device projects when such shank portion is inserted through a pair of web portion slots, for receiving the shank portion of a wedge bolt through such slot, said integral shank and head portions being constructed to withstand the stress of a load transmitted to the device from the workman's safety belt.

2. The combination of a safety device as defined in claim 1 and a concrete wall form side of the type described therein.

* * * * *